United States Patent [19]

Kondur, Jr. et al.

[11] 4,062,436

[45] Dec. 13, 1977

[54] MATRIX HEAD CALCULATOR PRINTER

[75] Inventors: Nicholas Kondur, Jr.; Robert H. Wilczewski; Charles M. Myers, all of Riverton, Wyo.

[73] Assignee: LRC, Inc., Riverton, Wyo.

[21] Appl. No.: 677,761

[22] Filed: Apr. 16, 1976

[51] Int. Cl.[2] ..... B41J 13/03; B41J 19/00

[52] U.S. Cl. ..... 197/82; 197/133 R; 197/151; 178/42; 197/164

[58] Field of Search ..... 197/1 R, 127 R, 131, 197/133 R, 138 R, 151, 82, 160, 164, 169; 101/93.04, 93.05; 178/41, 28

[56] References Cited

U.S. PATENT DOCUMENTS

| | | | |
|---|---|---|---|
| 3,324,240 | 6/1967 | Kleinschmidt et al. | 197/1 R X |
| 3,819,028 | 6/1974 | Drillick | 197/133 R X |
| 3,825,103 | 7/1974 | Riley | 197/151 |
| 3,840,107 | 10/1974 | Mack et al. | 197/151 X |
| 3,910,396 | 10/1975 | Eischen et al. | 197/82 X |
| 3,935,938 | 2/1976 | Hodne | 197/1 R X |
| 3,973,662 | 8/1976 | Fulton | 197/1 R |
| 3,986,594 | 10/1976 | Kondur, Jr. | 197/82 X |
| 3,990,559 | 11/1976 | Martin et al. | 197/1 R |

FOREIGN PATENT DOCUMENTS

| | | | |
|---|---|---|---|
| 2,119,200 | 4/1971 | Germany | 197/1 R |
| 2,533,006 | 7/1975 | Germany | 197/1 R |

*Primary Examiner*—E. H. Eickholt
*Attorney, Agent, or Firm*—John E. Reilly

[57] ABSTRACT

A lightweight, extremely compact printer apparatus has a constant speed drive which imparts reversible, translatory motion to a print head; and as the print head is advanced with respect to a platen imparts a direct mechanical drive to a paper advancing roller in order to advance paper from a feed roll line by line between printing operations. In turn, advancement of the paper or other recording medium from the paper roll drives a print ribbon supply holder to advance a print ribbon across the platen in front of the paper. The power requirements and size of the apparatus are substantially reduced to the extent that the apparatus is of a size corresponding to hand held calculator printers, since the movement of each element is utilized to drive another element successively from the print head carrier, paper advancement roller, paper roll to the print ribbon in close correlation to one another during each print cycle.

15 Claims, 8 Drawing Figures

MATRIX HEAD CALCULATOR PRINTER

This invention relates to printer apparatus, and more particularly relates to a novel and improved matrix head or dot printer specifically adaptable for use in calculator or data processing applications.

BACKGROUND OF THE INVENTION

Matrix head printer assemblies customarily employ solenoid driven print wires which are selectively actuated to form different numbers or characters as a series of dots resulting from the impressions formed by the wires on a recording medium. Generally, the recording medium or paper is advanced across a platen from a supply roll, and a print ribbon is positioned in front of the paper so as to form a dot on the paper when an impression is made by the end of a print wire. The print head which carries the print wires is caused to advance transversely of the direction of the paper through a print and return direction, the paper being indexed or advanced a predetermined distance at the end of each print line to present a new line for printing.

In copending application Ser. No. 527,603 now U.S. Pat. No. 3,986,594, filed Nov. 27, 1974 for SERIAL IMPACT CALCULATOR PRINTER, assigned to the assignee of this application, there is set forth and described a small printer characterized by having a matrix print head to selectively print different characters, numbers or symbols onto a recording medium by means of a print ribbon advanced between the print wires and recording medium. There, the print head is reversibly driven transversely of the direction of movement of the recording medium by a helical drive surface formed on a cylindrical member which is rotatably driven by a drive member at one end of the cylinder. Paper advancing rolls including a platen and pressure roll are arranged in closely spaced parallel relation to the cylindrical member, one of the rolls being incrementally driven by a drive pawl eccentrically mounted on the print head drive so as to index or advance the recording medium at the end of each print operation. The drive pawl selectively interengages with a ratchet on one of the paper advancing rolls to overcome a detent which releasably engages one of the paper advancing rolls and stations and recording medium securely in position during the printing operation. The detent along with the paper advancing rolls is also manually releasable to permit manual positioning or adjustment of the recording medium between printing operations. In addition, advancement of the printing ribbon is coordinated with the print head travel by a ribbon spool drive member mounted on the print head to selectively engage ratchet teeth on the ribbon spool at the end of each margin as the head traverses the recording medium, and the ribbon spool drive is operative to selectively engage one ribbon spool at a time so as to permit reversible advancement of the print ribbon. As a result, the printer apparatus as described is characterized by having extremely low power requirements as well as substantial reduction in size in comparison with conventional printer apparatus so that printers which provide permanent or printed records can be made available in a size and at a cost competitive with hand held units commonly referred to as hand calculators.

The present invention has similar objectives and aims in providing an extremely compact, low cost printer comprised of a minimum number of parts with minimal power requirements and achieving close, coordinated control over various operations to be performed in advancing the paper or other recording medium as well as reversibly advancing the print head and print ribbon with respect to the recording medium.

SUMMARY OF THE INVENTION

It is therefore an object of the present invention to make provision for a novel and improved matrix head printer apparatus which is adaptable for use in the hand calculator, adding machine, point of sale and data logging market.

It is another object of the present invention to provide for a matrix head printer which is extremely compact, portable and highly reliable and efficient in use and operation; further, wherein the printer has extremely low power requirements and makes maximum utilization of mechanical movement of the print head carrier to control other related functions of the printer.

It is a further object of the present invention to provide in a matrix head printer and the like for a novel and improved drive mechanism capable of reversibly advancing a matrix print head in a print and return direction at a predetermined rate of speed, and wherein the print head carrier is supported on one of the paper advancing rolls in such a way as to directly drive the roll for advancement of the paper or other recording medium in correlation with the printing operation.

It is a further object of the present invention to provide in a matrix head printer for a paper advancing mechanism responsive to translatory movement of the print head to index the paper or other recording medium from a paper roll and which permits the manual control and adjustment of the recording medium independently of the paper advancing roll between printing operations.

It is a still further object of the present invention to provide in a printer apparatus for an improved ribbon advance mechanism releasably engageable with a paper roll support shaft in such a way that indexing or advancement of the paper from the paper roll serves to selectively advance the printed ribbon from the ribbon spools in either desired direction of advancement transversely of the direction of advancement of the paper.

In accordance with the present invention, an extremely compact, low-profile printer apparatus has been devised which employs mechanical elements of the smallest possible size and arranged in such a way as to perform dual functions substantially throughout. In the preferred form, a print head is disposed on a print head carrier in confronting relation to a stationary print bar, the print head carrier having a drive track on its undersurface engaged by a drive pin on a relatively large gear forming part of a gear reduction train powered by a constant speed DC motor. Rotation of the drive pin by the motor imparts translatory movement to the carrier transversely of the platen, and the carrier in turn imparts rotation to a paper advancing roller in the return direction of travel of the matrix head so that the paper or other recording medium is indexed or fed upwardly by the paper advancing roller across the platen. In addition, a print ribbon is disposed for extension between a pair of print spools or holders located on opposite sides of a feed roll for the paper, the ribbon spools being selectively engageable with the paper feed roll 24 so as to be responsive to rotation of the paper feed roll 24 to advance the ribbon R across the paper and platen. Specifically, the print ribbon spools are so mounted that either can be selectively engaged with the paper feed roll shaft to determine the direction of advancement of the print ribbon across the platen. Other features of the printer assembly include a manual release lever to selectively release the paper advancing roller from a gripping engagement with the paper and a tilt frame to permit selective refilling of the paper feed roll and of the print ribbon when necessary.

The above and other objects, advantages and features of the present invention will become more readily understood from the following detailed description of a preferred embodiment of the invention when taken together with the accompanying drawings, in which:

DETAILED DESCRIPTION OF THE PREFERRED EMBODIMENT

Figure 1:
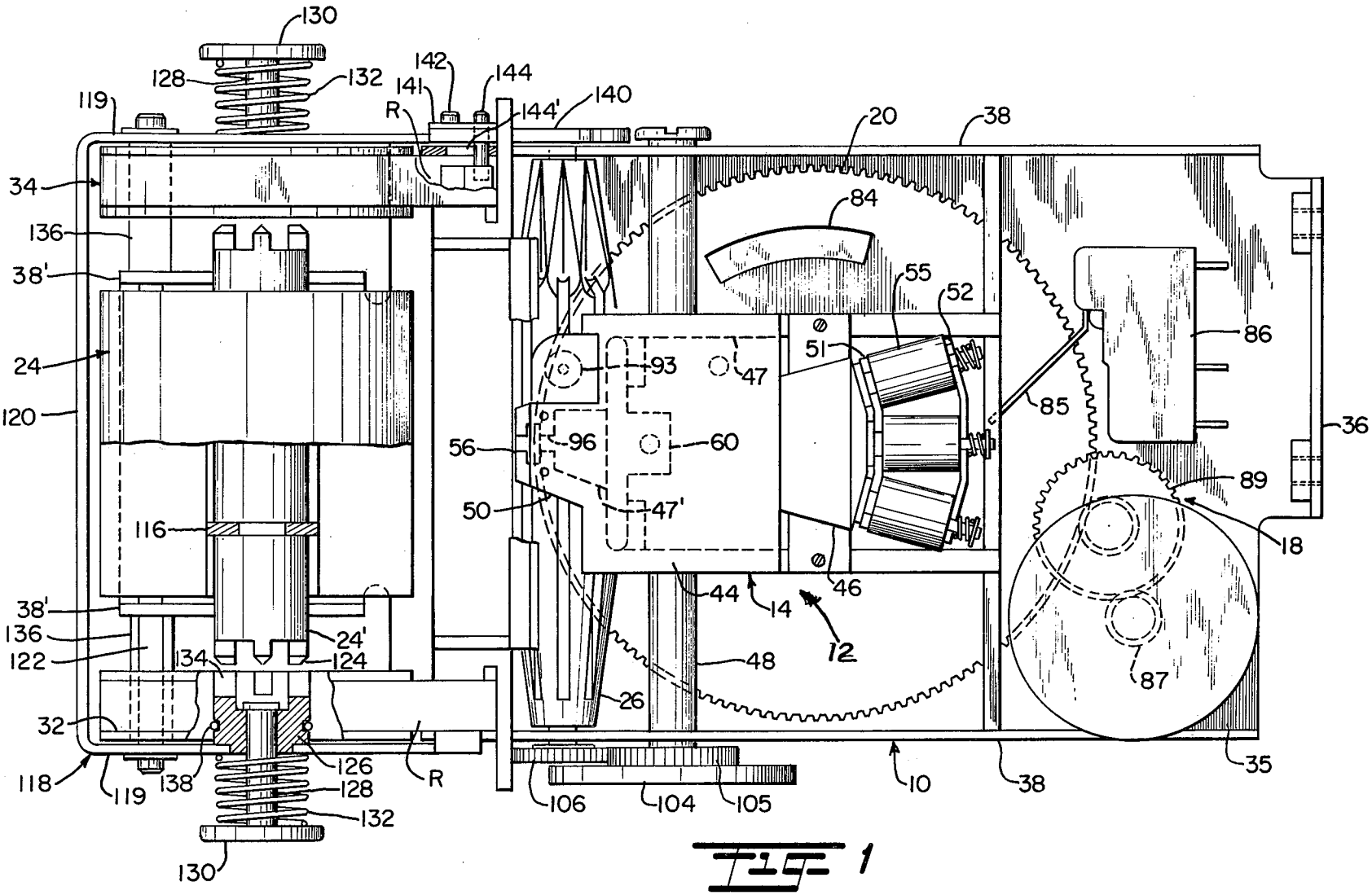
FIG. 1 is a top plan view of a matrix head printer apparatus, in accordance with the present invention, with portions broken away to illustrate in section the detent and paper feed assemblies.
Figure 2:
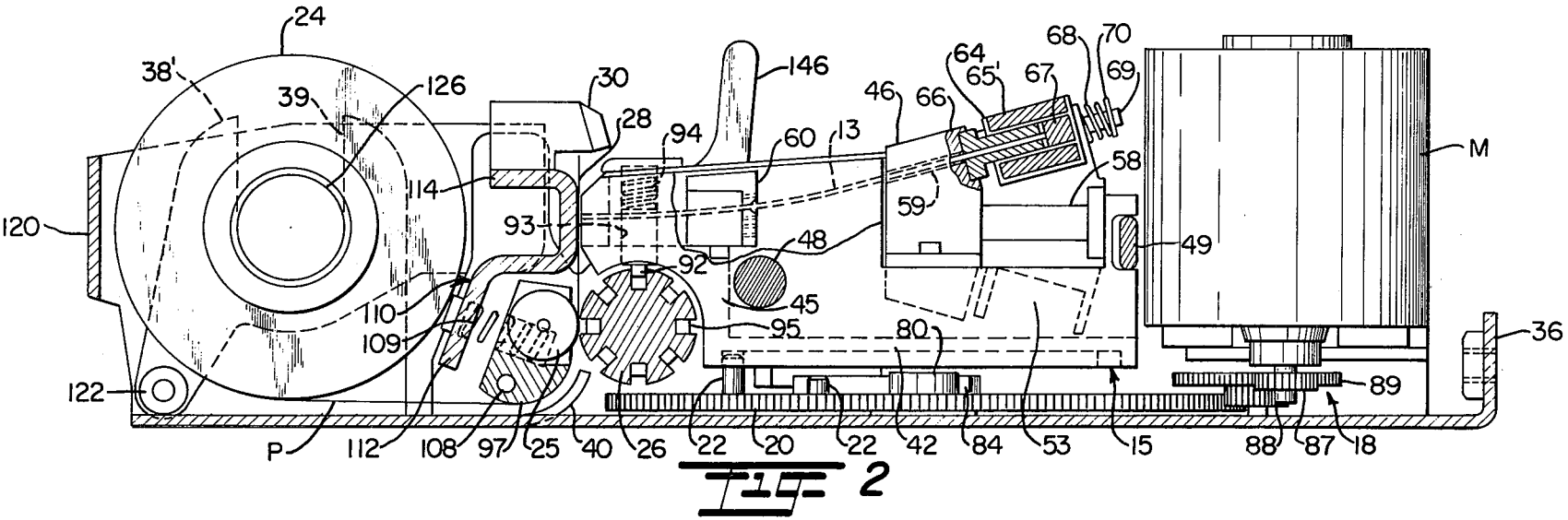
FIG. 2 is a side view partially in section of the preferred form of invention shown in FIG. 1.
Figure 3:
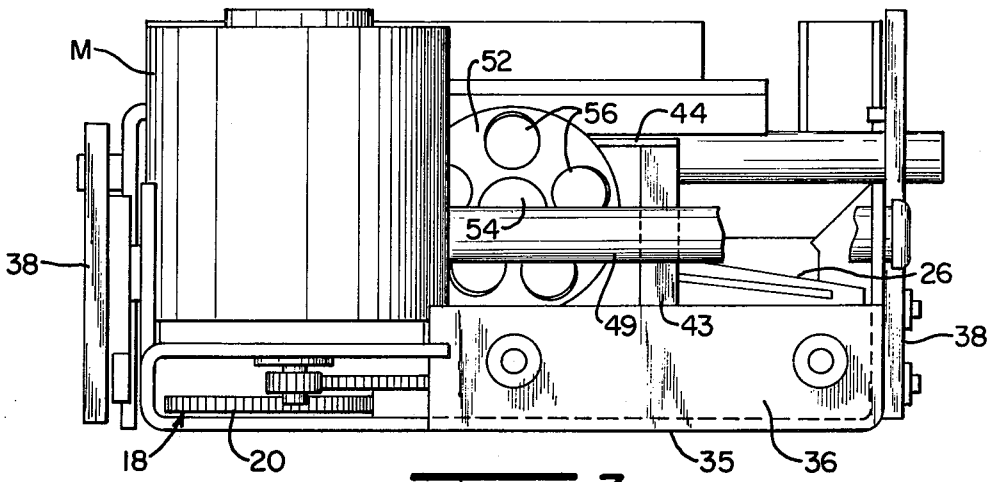
FIG. 3 is a rear end view with portions broken away of the printer apparatus shown in FIGS. 1 and 2.
Figure 7:
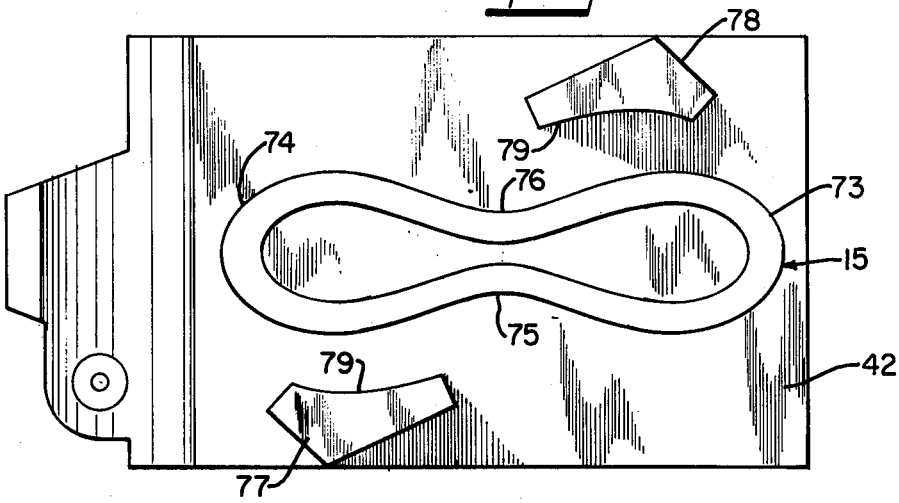
FIG. 7 is a plan view of the drive track for the print head carrier.

Referring in more detail to the drawings, there is shown by way of illustrative example in FIGS. 1 to 3 a preferred embodiment of the present invention broadly comprised of a low-profile main frame 10 in which is supported a matrix print head assembly 12 on a drive carrier 14, the assembly 12 having a plurality of solenoid-actuated print wires 13 selectively energized to form each number or character on a recording medium. The carrier 14 includes a drive track 15 on its undersurface, as shown in FIG. 7, to drive the print head assembly 12 in a direction transversely of the length of the main frame 10. A motive power source is defined by a constant speed DC motor represented at M including therein a replaceable battery pack, not shown, the motor M being operative through a gear reduction train designated at 18 to rotate a main gear 20, the latter including an upstanding pin 22 which is inserted into the drive track 15 to impart translational movement to the print head assembly 12 in response to rotation of the gear 20. A shaft 24' supports a paper feed roll 24 for free rotation in supplying a continuous length of paper represented at P which advances along a guide path upwardly between a pressure roll 25 and a paper advance roller or feed cam 26 in front of a print bar 28 and tear-off blade 30. Print ribbon spools 32 and 34 are mounted on opposite sides of and in coaxial relation to the paper feed roll 24 to advance a print ribbon R along the front surface of the print bar 28 and in front of the paper P. In a manner to be described, the paper advancing roller 26 is directly responsive to translational movement of the print head carrier 14 to advance the paper upwardly past the platen, and in turn the print ribbon spools are selectively and alternatively engageable with the paper feed roll shaft 24' to advance print ribbon R in either desired direction of movement past the print bar 28 as the paper feed roll shaft is rotated by upward advancement of the paper in response to rotation of the paper advancing roller 26.

Considering in more detail the construction and arrangement of the preferred embodiment of the present invention, as shown in FIGS. 1 to 3, the main frame 10 has a generally rectangular base plate 35 which terminates at its rear end in an upstanding end frame portion 36. Opposite side frame portions 38 formed by elongated, flat narrow plates extend along opposite sides of the base plate 35 from the rear end and terminate just forwardly of the roller 26 in upward and forward extensions or cradle supports 38' having aligned, vertically extending open slots 39 which are adapted to receive opposite ends of the paper shaft 24'. In addition, the horizontal base 35 has an upwardly and rearwardly curved flange 40 of limited extent which cooperates with the paper advancing roller 26 in defining a guide path for movement of the paper P from the paper feed roll 24.

The print head carrier 14 is defined by a relatively wide generally rectangular support block having a bottom plate 42, opposite sides 43, a top plate 44, front guide body 45 and rear mounting block 46 rigidly interconnected to define a central cavity 47 for forward convergent extension of the print wires 13 from the matrix head assembly 12. In order to support the drive carrier 14 and matrix head assembly 12 for free translational movement between the main side frame portions 38, front and rear support shafts 48 and 49 are mounted for transverse extension between the side frame portions through aligned front and rear openings in the sides 43 of the carrier 14. The guide body 45 is disposed directly above the front support shaft 48 and has a central forwardly convergent cavity 47' forming a continuation of the cavity 47, the guide body 45 terminating in a front tapered nose portion 50 having a bearing 56 at its forward extremity. The upright mounting block 46 at the rearward end of the carrier 14 has lateral extensions or ears resting upon and fastened to upper edges of the opposite sides of the guide body, and the block 46 is provided with a pair of axially spaced front and rear, generally convex supporting flanges 51 and 52 defining therebetween an annular, generally conical forwardly convergent recess 53 for mounting and disposition of a series of five print wire solenoids 55 at spaced circumferential intervals between the flanges 51 and 52, one of the solenoids illustrated in section in FIG. 2. The solenoids are so arranged in the recess 53 as to diverge rearwardly from the front support flange 51 and have their rearward ends supported in spaced openings 56 in the rear flange 52, the front and rear support flanges being rigidly connected to the guide body 45 by a fastener 54 such as a rivet or screw extending through a central sleeve 58 in the mounting block 46. Additionally, a plurality of forwardly convergent guide passages 59 are arranged at spaced circumferential intervals in the mounting block 46 and are aligned to receive the print wires 13 which extend from the solenoids 55 through the guide passages 59 and continue through the central cavity 47 into the tapered nose portion 46 and terminate in the vertical bearing 56. To serve as an additional guide for the print wires, a prealigner or guide plate 60 is supported on the upper edge of a vertical wall extending between opposite sides of the guide body 45, the plate 60 having a series of openings therein adapted to receive and guide the print wires 60 in a more nearly vertical alignment for passage through vertically spaced guide openings in the front bearing portion 47. In a conventional manner, the print wires 13 are controlled by electronic circuitry so that selected ones of the solenoids are activated to cause the print wires to be driven forwardly through the front bearing 56 to strike the print ribbon R and form a character or number made up of a series or matrix of dots. As illustrated in FIG. 2, each solenoid includes a bobbin 64 which receives a solenoid coil 65' in surrounding relation to a front pole piece 66 and rearward armature 67, the trailing end of the print wire 13 passing through the pole piece 66 and being permanently affixed to the armature 67 so as to be driven forwardly in response to energization of the solenoid coil 65'. A return spring 68 is disposed in surrounding relation to a rearward extension 69 of the armature 67 and is interposed between a retainer ring 70 and the rear support plate 52.

In order to impart translatory movement to the carrier 14, as previously referred to, the undersurface of the bottom plate 42 of the carrier 14 is provided with the drive track 15 which, as shown in more detail in FIG. 7, is defined by a downwardly facing groove in the form of an elongated loop having its major axis extending longitudinally of the main frame 10, the endless loop comprising a pair of interconnecting loop portions 73 and 74 converging inwardly into common, relatively narrow, reverse curved intermediate portions 75 and 76. The drive track 15 also includes auxiliary cam surfaces 77 and 78 on diagonally opposite sides of the loop, each provided with a generally concave surface 79 spaced laterally of, and conforming to the configuration of, the side portions of the loop as illustrated.

Figure 8:
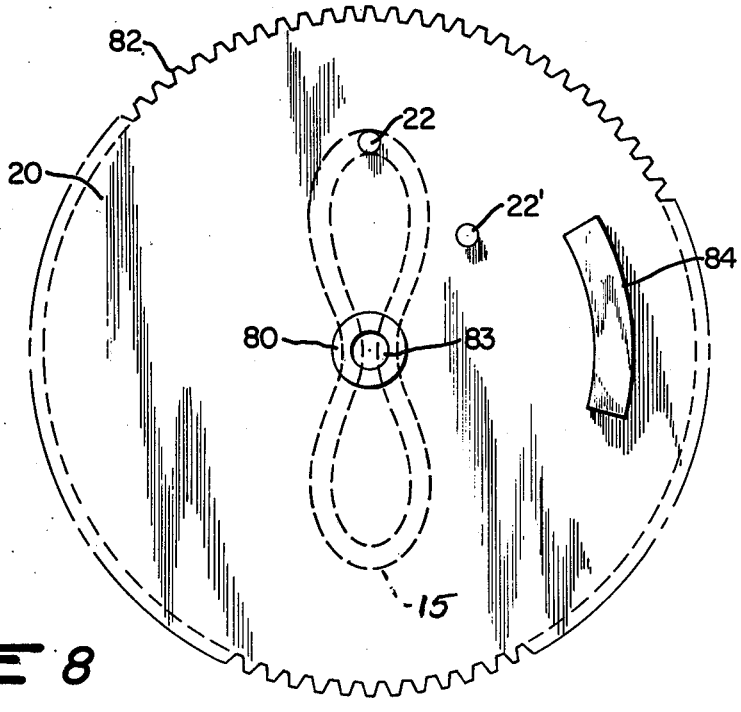
FIG. 8 is a plan view of the drive gear for the print head carrier and its relationship to the drive track which is shown at right angles to FIG. 7.

The main drive gear 20 is illustrated in FIG. 8 and is seen to comprise a flat circular plate upon which is mounted the drive pin 22, the plate including a central bearing 80 and outer peripheral gear teeth 82. The drive gear 20 is journaled for rotation on a stud 83 projecting upwardly from the base plate 35 of the main frame 10 so that the drive pin 22 is aligned for insertion into the drive loop 15. Specifically, alignment of the drive pin 22 with respect to the drive track 15 is such that when the drive carrier 14 is at one end of its travel adjacent to one of the side frame portions 38, the drive pin 22 is at the midpoint of one of the reverse curved portions 75 and 76; and as the carrier reaches the midpoint of the frame intermediately between its end limits, the pin 22 will have advanced to the extreme end portion of one of the loops 73 or 74 as the pin is rotated by the drive gear 20 as shown in FIG. 8. In this relation, the loop is given a configuraton such that advancement of the drive pin along the drive track under rotation of the drive gear will impart a constant rate of speed to the carrier laterally across the frame; and to this end the configuration of the loop is such that the lateral direction of force imparted by the pin to the carrier is constant notwithstanding rotation of the drive pin from a point at the end of the loop in which its tangential direction of movement is parallel to the desired direction of travel of the carrier to a point at the midsection in which the tangential direction of movement is perpendicular to the drive carrrier. However, at the closed end of each loop 73 and 74 there occurs a brief dead interval due to the necessary clearance between the pin and drive track at which the pin will not impart directional movement to the carrier. In order to compensate for this dead interval, the auxiliary cam surfaces 77 and 78 are so positioned as to be engaged by an auxiliary guide pin 22' so as to continue to impart constant speed travel to the carrier 14 throughout the dead interval. The configuration of the drive track in cooperation with the auxiliary cam surfaces 77 and 78 offers a smooth transition in bringing about reversible movement of the drive carrier, first, as it advances from right to left in printing then is reversed at the margin for return in a left to right direction to its starting point in completion of each printing cycle. Specifically, by reference to FIG. 8, assuming that the drive gear is rotated in a clockwise direction, the printing operation will be initiated with the drive pin 22 at the midpoint of the reverse curved section 75. As the drive pin approaches the extreme end of the loop 73, the auxiliary drive pin 22 will have advanced into engagement with the concave surface 79 of the cam 78 to impart a constant driving force to the drive carrier 14. As the drive pin reaches the opposite midsection of the reverse curved portion 76 opposite to the cam surface 78 the carrier will have reached the lefthand margin at the end of the print line; and, under continued rotation of the drive pin the carrier will undergo a reversal in movement for return to its starting point. Once again, as the drive pin approaches the closed end of the loop 74, the auxiliary drive pin 22' will engage the cam surface of cam 77 to continue to drive the carrier through the dead interval.

In order to initiate a typical printing operation, a switch cam 84 of arcuate configuration projects upwardly from the surface of the drive gear in leading relation to the auxiliary drive pin 22' so as to normally engage a switch lever 85 located adjacent to the motor drive at the end of each print cycle. When a "print" command is received, the motor is energized and the switch cam 84 will remain in engagement with the switch lever 85 for a predetermined time interval to assure that constant velocity has been attained whereupon the switch cam 84 will disengage the switch lever 85 to cause an electrical signal to be generated indicating that the carrier is moving at a constant velocity and is in the correct position relative to the paper P for printing to begin. At the end of each print cycle, return movement of the switch cam 84 into engagement with the lever 85 will de-energize the motor M until the next "print" command is received. The constant speed DC motor M imparts rotation to the drive gear 20 through a speed reducer comprising a pinion gear 87 mounted on downwardly projecting drive shaft 88 of the motor, the pinion gear 87 driving the larger diameter gear portion of intermediate gear 89. The smaller diameter portion of the gear 89 imparts rotation to the drive gear 20 in a clockwise direction as indicated in FIG. 1.

The paper or other recording medium P is indexed or spaced line-by-line in direct response to translational movement of the print head assembly through the interengagement of a spring-loaded drive pin 92 in the nose 50 of the drive carrier 14 with the paper advancing roller 26. The guide body 45 at the forward end of the drive carrier 14 is recessed at the underside of the carrier to conform to the paper advancing roller 26, and the drive pin 92 projects downwardly from an upper plunger portion 93 which is normally urged downwardly through a vertical bore in the guide body 45 by spring 94 to urge the drive pin into one of the axial grooves 98 hereinafter described on the external surface of the paper advancing roller. The plunger is offset from the center of the guide body as illustrated in FIG.

2 to permit forward extension of the print wires 13 through the cavity 47'.

Figure 5:
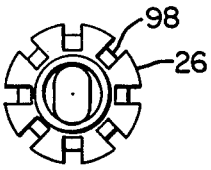
FIG. 5 is an end view of the paper advancing roller.
Figure 4:
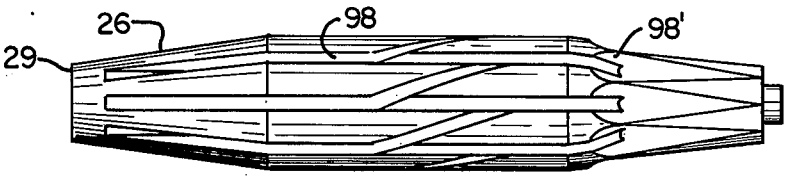
FIG. 4 is an elevational view in detail of the paper advancing roller.
Figure 6:
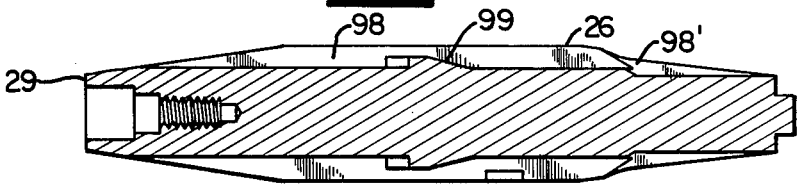
FIG. 6 is a longitudinal sectional view of the paper advancing roller.

A paper guide path is established by advancing the paper P horizontally in a rearward direction from the bottom of the feed roll 24 upwardly through the space formed between the flange 40 on the base of the main frame 10 and the convex surface of retainer 97 for the pressure roll 25. The paper then advances upwardly through the interface formed between the pressure roll 25 and paper advancing roller 26 past the platen 28 and the tear-off blade 30. In this way, upward advancement of the paper can be controlled by relative rotation between the paper advancing roller 26 and spring loaded pressure roll 25 in response to translational movement of the drive carrier 14 in the return direction. Specifically, this is accomplished by forming the axial grooves 98 at equally spaced circumferential intervals around the external surface of the roller 26. As the print head advances from right to left, the drive pin is gradually retracted upwardly as it advances along one of the axial grooves 98 as a result of the upward inclination or slope in the bottom of that groove, as shown in FIGS. 4 to 6. The uwpard sloping from right to left as at 99 in each axial groove occurs between the cross-over or intersection of the axial groove with a helical groove 100; and at the intersection with the helical groove 100 the bottom of the axial groove 98 will return to its original level so that the pin will continue its travel along that axial groove. However, when the carrier returns from left to right in the non-printing portion of the cycle, the resultant dropoff or shoulder formed by the intersection of the grooves 98 and 100 will cause the drive pin not to re-enter that portion of the axial groove 98 but instead to enter the helical groove 100 so as to cause the cam to rotate in a clockwise direction, as viewed in FIG. 2, and index the paper P upwardly one line as a preliminary to the next printing operation. As the carrier 14 approaches the righthand side of the printer, the switch cam 84 will engage the switch lever 85 thereby activating the switch 86 and causing an electrical signal to be generated to shut off the electrical current to the motor as a result of which the carrier 14 will come to rest at the righthand side of the printer. In this position, it will be noted that the axial grooves 98 on the paper advance roll are flared as at 98' so that the drive pin 92 will clear the grooves at the right end of the paper advance roll so as not to prevent the advance roll 26 from being rotated manually for manual paper advance. This rotation is accomplished by the manually rotatable twirler 104 which is supported by and journaled to the end of the front support shaft 48 and has a gear 105 formed on its inner surface which intermeshes with a paper feed gear 106, the latter being keyed for rotation to the end of the paper feed cam or roller 26. Thus, when the twirler 104 is manually rotated it will through the intermeshing gears 105 and 106 rotate the cam 26 to cause advancement of the paper P in either desired direction.

The pressure roller retainer 97 is rotatable about a pin 108, the retainer supporting the pressure roller 25 firmly against the paper feed cam 26 under the urging of a pair of spaced pressure roller springs 109 one being illustrated in FIG. 2. The pressure roller 25 also is free to rotate within the retainer 97 and when the paper feed cam 26 is driven in a clockwise direction by the drive pin 92 the pressure roller 25 will be urged by the cam 26 to rotate in a counterclockwise direction so as to advance or index the paper P upwardly past the platen 28. In this relation, the platen 28 preferably defines the upper vertical extension of a fixed mounting bracket 110 which is mounted between the main side frame portions 38 and provides a lower inclined portion 112 to support the pressure roller springs 109, an upper generally U-shaped portion 114 which defines the platen surface 28 and includes a horizontal extension which supports the tearoff blade 30 as shown in FIG. 2.

The cradle support 38' on the main frame supports the paper shaft 24' for free rotation in the slots 39, and the paper feed roll 24 is securely disposed for rotation with the shaft 23 by means of a pair of axially spaced elastomeric washers 116, one being illustrated in the plan view of FIG. 1, so that the paper feed roll 24 is frictionally held in surrounding relation to the shaft 23 against slippage with respect to the shaft while permitting the feed roll to be readily removed from the shaft when it is necessary to replace it with a new supply of paper. The ribbon spools 32 and 34 are supported in normally outwardly spaced coaxial relation to the paper feed shaft 23 by a tilt frame 118 which is in the form of a generally U-shaped bracket having opposite ends 119 disposed outwardly of the main frame 10, the opposite ends 119 being interconnected by a common plate 120 extending across the front end of the frame. Opposite ends 118 of the tilt frame are supported for limited pivotal movement of the frame about a tilt shaft 122 which extends transversely across the front end of the frame and is supported by the lower ends of the cradle 38'. The tilt frame additionally includes openings in each end 119 aligned with the slots 39 in the cradle to receive ribbon spool hubs 126 which support the ribbon spools 32 and 34. A shift pin 128 is disposed in inner concentric relation to each ribbon spool hub and is shiftable axially with respect to the hub by applying manual pressure to the shift button 130 at the external end of the shift pin. When one of the two shift pins is pushed inwardly towards the paper feed shaft by applying manual pressure to the shift button the paper feed shaft 24' is forced axially until the circumferential teeth 124 on the shaft advance into engagement with complementary teeth 134 on the inner surface of the ribbon on that side of the machine opposite to the pin 128 which was so shifted. A return spring 132 is interposed between the shift button 130 and the tilt frame 118 in order to return the shift pin 128 to its original centered or outwardly disposed position when released, as illustrated in FIG. 1. In this relation, the paper shaft washers 116 act against the inside of the core of the feed roll 24 so as to maintain the axial position of the paper shaft when axially shifted while causing the shaft to rotate with the feed roll 24 as the paper is indexed or advanced by the feed cam 26. It will be noted that the tilt frame shaft 122 is provided with spacer sleeves 136 to hold the end of the tilt frame in uniformly spaced relation to the cradle 38' notwithstanding axial shifting of the paper feed shaft.

As the paper P is advanced past the platen or bar 28 during return motion of the carrier 14 from left to right, the feed roll 24 is caused to rotate in a counterclockwise direction thereby imparting a like rotation to the paper feed shaft 24'. If the paper feed shaft 24' has been pushed into one of the ribbon spools 32 or 34 it will cause that spool to correspondingly rotate in a counterclockwise direction thereby advancing the inked ribbon R horizontally across the platen 28 and in front of the paper P. Each ribbon spool is suitably provided with a drag spring 138 which is permanently assembled on each ribbon spool as shown and serves two functions: First, to resist any relative movement between the ribbon spools and their respective hubs so that some measure of tension is maintained in the ribbon R in advancing across the face of the platen 28; and secondly, to detent in circumferential grooves on the ribbon spool hubs so as to hold the spools against the hubs but permit relative rotational motion therebetween. Thus, the springs 138 take up any slack in the ribbon and avoid overrunning of one spool with respect to the other as the ribbon is drawn from one spool across the platen. In order to reverse the direction of ribbon advance, of course the paper shaft 24' is simply forced in the opposite direction by the shift button to cause the circumferential teeth 124 on the opposite end of the paper shaft to advance into engagement with the complementary teeth on ribbon spool. When the paper feed shaft is in its centered position, the tilt frame may be pivoted or rotated about the tilt shaft a limited distance so as to lift the spools 32 and 34 away from the paper feed roll and permit their removal from their respective hubs by drawing them inwardly away from the hubs and replacing with a fresh supply of ribbon. Similarly, the paper feed shaft when centered between the spools may be removed from its cradle 38' for replacement of the paper feed roll.

A manual release lever 140 extends upwardly along one of the side frame portions of the main frame including a lower connecting end 141 which is pivotally connected to an extension 142 of pin 108 and also secured to a second pin 144 which extends from rigid connection to the retainer 97 through an elongated slot 144' in the side frame 38. The opposite end of the release lever includes a handle 146 projecting upwardly above the side frame. When the handle is pushed forwardly to cause the lever 140 to advance the pin 144, the pressure roller retainer 97 is rocked forwardly away from the paper so as to release the pressure roll 25 from gripping engagement with the paper as best seen from FIG. 1. The release lever 140 is useful in permitting adjustment or free movement of the paper when desired; also, the paper roll 24 may be extracted when the release lever 140 is in the released position simply by lifting the paper roll out of the cradle and withdrawing the paper from the quide path as described.

It is possible to employ a relatively small, low torque motor to impart constant speed travel to the print head at a relatively low rate of speed such that the print wires can be actuated to form impressions on the recording medium without incrementally stopping the drive motor. In this relation, and while forming no part of the present invention as such, it is desirable that electrical pulses be applied to the solenoid coil in a predetermined sequence so as to form the desired characters on the recording medium or paper P. For instance, to produce the upright portion of the letter "L" or other vertical line, all five print wires would normally be actuated at approximately the same time. If they were actuated at precisely the same time the current demand on the battery could be greater than that which the battery could supply to properly actuate the print wire and therefore yield an unacceptably light print on the paper. In order to correct this, the solenoid coils are supplied with electrical pulses in a serial sequence resulting in a barely imperceptible slant to an otherwise vertical line so that the matrix for each character is formed by selectively actuating one or more of the print wires 13 at closely spaced intervals as the carrier 14 is advanced at a constant speed across the paper. Printing continues on each line of the paper until the carrier 14 nearly reaches the left side of the machine at which point it is reversed and returned to its starting point on the right side of the machine for the next line of print. As it is reversed, the paper advancing roller 26 is indexed to advance the paper one line. Simultaneously, advancement of the paper will cause the print ribbon R to be incrementally advanced from one of the print spools 32 or 34 in the manner described. At the end of its reversal, the switch cam 84 will engage the switch lever 85 to deenergize the motor M until the next "print" command is received. For the purpose of illustration and not limitation, the drive motor M may be a direct current motor having a starting torque on the order of 20 gram centimeters which is capable of rotating at a speed of 2400 rpms. The reduction ratio from the motor to the drive gear is on the order of 37 to 1 as a result of which the drive gear is rotated approximately 50 rpms, and the print head is advanced across the paper at the rate of 2.68 inches per second.

In the construction and arrangement of elements as described, the preferred form of unit as illustrated may be dimensioned to be on the order of 3 to 4 inches in length by less than 1 inch in heighth. However, even the height of the unit may be further reduced by reducing the size of the paper supply or feed roll 24 as well as the manual release lever 140.

It is therefore to be understood that various modifications and changes may be made in the specific construction and arrangement of parts comprising the preferred form as herein described without departing from the spirit and scope of the present invention as defined by the appended claims and reasonable equivalents thereof.

What is claimed is:

1. A printer unit comprising in combination:

a print head assembly, motive drive means including a drive member thereon, a print head carrier incluing a drive track engageable by said drive member on said motive drive means to impart reversible, translational movement to said print head carrier in response to activation of said motive drive means, and a record medium advancing drive member on said print head carrier, said drive track defined by a generally oval-shaped loop elongated in a direction normal to the translational movement of said print head carrier, a record medium advance roller engageable with said record medium advancing drive member whereby to advance a record medium in a direction normal to the direction of translational movement of said print head carrier, record medium feed means adapted to supply continuous lengths of a record medium along a guide path to be engaged by said record medium advance roller, and a print ribbon and holder means therefor operative to advance the print ribbon along a path extending transversely in front of said recording medium.

2. A printer unit according to claim 1 said drive track including auxiliary cam members cooperating with said loop in maintaining a predetermined continuous movement of said print head carrier through a complete print cycle consisting of a traversal of said record medium in a print and opposite return direction.

3. A printer unit according to claim 1, said print head carrier including front and rear support members in horizontally spaced relation to one another.

4. A printer unit according to claim 3 said print head carrier being in the form of a generally rectangular frame having opposite ends journaled on said support members, and said print head assembly supported in said generally rectangular frame.

5. A printer unit according to claim 1 said record medium advance roller extending horizontally in a direction parallel to the direction of movement of said print head assembly, said roller having axially extending grooves at spaced circumferential intervals engageable with said record medium advance drive member in the print direction and spiral grooves engaged by said drive member in a return direction to impart rotational movement to said advancing roller in the return direction causing movement of said record medium.

6. A printer unit according to claim 1, said holder means for said print ribbon being defined by ribbon spools mounted in spaced coaxial relation to opposite ends of said record medium feed means and including means releasably and alternately engageable with opposite ends of said feed means to selectively and reversibly advance said print ribbon.

7. A printer unit according to claim 1 further including a pressure roll yieldingly urged against said record medium advance roller to form a guide path for advancement of the recording medium, and a manual release lever engageable with said pressure roll to retract it away from engagement with said record medium advance roller whereby to permit advancement of said record medium independently of said record medium advance roller.

8. A printer unit according to claim 1, guide means on said record medium advance roller to permit said carrier to move out of engagement with said record medium advance roller at least at one end limit of travel, and manual advancing means on said record medium advance roller to permit indexing of said record medium independently of translational movement of said carrier.

9. A printer unit according to claim 1, said motive drive means including a speed reduction mechanism, said drive member defined by a rotatable drive pin disposed for rotation by said motive drive means beneath said carrier, said drive track disposed on the undersurface of said carrier and said generally oval-shaped loop being of a configuration such that when engaged by said drive pin it will impart constant speed travel to said carrier.

10. A matrix head printer unit comprising in combination:

a main frame, a matrix print head assembly, motive drive means including a drive member, a print head carrier adapted to undergo translational movement in response to activation of said motive drive means, and a paper advancing drive member associated with said print head carrier, a paper advance roller having drive surfaces engageable with said paper advancing drive member whereby said paper advance roller is rotated in a direction normal to the direction of translational movement of said print head assembly, a rotatable paper feed roll member adapted to supply continuous lengths of paper along a guide path so as to be engaged by said paper advancing roller, and a print ribbon and holder means therefor engageable with said feed roll member whereby to advance the print ribbon along a path extending transversely of said paper in response to rotation of said feed roll member.

11. A matrix head printer unit according to claim 10, said print head carrier slidably mounted on front and rear support shafts in horizontally sapced relation to one another, said print head carrier being in the form of a generally rectangular frame having opposite ends journaled on said support shafts, and said matrix print head assembly supported in said generally rectangular frame.

12. A matrix head printer unit according to claim 10 said paper advance roller extending horizontally in a direction parallel to the direction of movement of said print head assembly, said roller having axially extending grooves at spaced circumferential intervals along the substantial length of said roller through which said paper advance drive member advances in the print direction and cross-over spiral grooves interconnecting adjacent axial grooves and engageable by said paper advance drive member in a return direction to impart rotational movement to said advancing roller in the return direction causing upward movement of the paper, and flared guide means at one end of said axial grooves to permit said roller to be rotated independently of said drive carrier while being operative to guide said drive member into an axial groove at the beginning of each print cycle.

13. A matrix head printer unit according to claim 12, including a pressure roll yieldingly urged against said advancing roller to form a guide path for advancement of the paper, and a manual release lever engageable with said pressure roll to retract it away from engagement with said advancing roller whereby to permit advancement of said paper independently of said advancing roller.

14. A matrix head printer unit according to claim 10, said holder means for said print ribbon being defined by ribbon spools mounted in spaced coaxial relation to opposite ends of a shaft for said feed roll and including means releasably engageable with each end of said paper feed roll shaft to selectively advance said print ribbon.

15. A matrix head printer unit according to claim 10, said print head carrier including a drive track operative to impart reversible, translational movement to said print head assembly in response to rotation of said drive gear, said drive track formed of a generally oval-shaped loop elongated in a direction normal to the translational movement of said print head and including auxiliary cams cooperating with said loop in maintaining a predetermined continuous movement of said print head carier through a complete print cycle consisting of a traversal of said recording medium in a print and opposite return direction, and a paper advancing drive member on said drive carrier.

* * * * *